12/1/87 XR 4,710,776

United States Patent [19]

Roederer et al.

[11] Patent Number: 4,710,776

[45] Date of Patent: Dec. 1, 1987

[54] POWER DIVIDER FOR MULTIBEAM ANTENNAS WITH SHARED FEED ELEMENTS

[75] Inventors: Antoine G. Roederer, Noordwijk, Netherlands; Guilio Doro; Marco Lisi, both of Rome, Italy

[73] Assignee: Agence Spatiale Europeenne, Paris, France

[21] Appl. No.: 680,800

[22] Filed: Dec. 13, 1984

[30] Foreign Application Priority Data

Jan. 5, 1984 [FR] France ..... 84 00103

[51] Int. Cl.[4] ..... H01Q 13/00

[52] U.S. Cl. ..... 343/778; 343/754; 343/779

[58] Field of Search ..... 343/754, 778, 779, 781 CA

[56] References Cited

U.S. PATENT DOCUMENTS 3,631,503 12/1971 Tang ..... 343/754
4,090,203 5/1978 Duncan ..... 343/778
4,101,901 7/1978 Kommrusch ..... 343/853
4,156,243 5/1979 Yorinks et al. ..... 343/779
4,236,161 11/1980 Ohm ..... 343/781 CA

*Primary Examiner*—James W. Davie
*Assistant Examiner*—Robert E. Wise
*Attorney, Agent, or Firm*—Bachman & LaPointe

[57] ABSTRACT

The invention provides an antenna for transmitting or receiving closely spaced multibeams with very low level sidelobes comprising, for each beam feed, a primary feed feeding one or more main elements surrounded by secondary elements some of which are shared between several adjacent beam feed, the power supplied by the primary feed being distributed to the different elements by means of couplers. According to the invention, each shared element is fed by each of the power transmission lines feeding the main element (E1, E'1) of said adjacent beams through a coupler, each transmission line of a secondary radiating element (L2, L'3) comprising at least two couplers (C1, C2) in series.

8 Claims, 8 Drawing Figures

POWER DIVIDER FOR MULTIBEAM ANTENNAS WITH SHARED FEED ELEMENTS

The invention relates to an antenna system for radiating or receiving closely spaced multibeams and having very low level sidelobes, thus allowing for example the same frequency to be used in several of these beams with a good signal to noise ratio. Such an antenna system comprises primary feeds which may illuminate a focusing device formed of reflectors and/or lenses.

Such antenna systems comprise a primary feed for each beam which must have both a limited surface so as to allow small spacing of the beam required but also an extensive surface for producing illumination supplying the low level required for the sidelobes. These requirements, which are contradictory, lead to the use for each beam of a primary feed formed from a group of radiating elements namely one or more main elements surrounded by peripheral secondary elements, the peripheral secondary elements being possibly shared between several adjacent beams. For each primary feed a central element may for example be provided which receives the largest part of the power to be radiated and which is surrounded by six peripheral elements which share the rest of the power of the beam between them. Partial overlapping may then be provided of the primary feeds of adjacent beams sharing between them one or more of their peripheral feed elements.

In this antenna system, the problem arises of dividing, with a minimum of losses, the power intended for one beam among the elements of the primary feed of this beam, some of these elements being shared with primary feeds of one or more adjacent beams.

Three types of power dividers are known at present for multibeam antennas. The first type of power divider comprises a divider circuit at the level of the shared elements and its principle is illustrated in FIG. 1.

Each beam is formed by a primary feed placed close to the focal point of a focusing device F and comprising three radiating elements, namely a main element E1, respectively E'1 and two secondary elements E2 and E3, respectively E'2 and E'3, element E2 or E'3 being the same element shared between the two beams. The divider of the first beam comprises an input transmission line L1 which is fed by a generator G which comprises for example an amplifier and an oscillator at a frequency $f_1$; a first coupler C12 divides the power among the transmission line L1 and the transmission line L2 which feeds the radiating element E2 ; a second coupler C13 divides the power among the transmission line L1 and the transmission line L3 which feeds the radiating element E3. The coupling value of coupler C12 is 1/5 so as to distribute 80% of the power to line L2 and 20% of the power to line L1; the coupling value of coupler C13 is $\frac{1}{8}$ so as to distribute 70% of the power to the radiating element E1 and 10% of the power to line L3.

The second beam also is formed by a generator G' which feeds a feed line L'1 which is connected to a transmission line L1 which feeds a load Ld through a coupler C'13 with coupling equal to 1/5 and to a transmission line L'2 which feeds the radiating element E'2 through a coupler C'12 whose coupling value is equal to $\frac{1}{8}$. The intermediate transmission line LI is connected to the transmission line L'3 of element E'3 which is the same as the feed line L2 of the first feed through a divider circuit D which is a divide by two divider in the case where the radiating element E2 or E'3 is shared between two beams but which would be a divide by three divider if this element were shared between three beams.

The power which is supplied by generator G through the coupler C12 to line L2 is divided in two halves by divider circuit D, one half feeding the element E2 and the other half being lost in the load Ld. It can then be seen that 10% of the power supplied by generator G is lost in the load Ld. It is therefore obvious that this type of power divider has a high loss factor and that it further requires a divider circuit for each of the shared radiating elements.

FIG. 2 illustrates the principle of a second type of power divider with a frequency multiplexer. In this case, the divider circuits of the first power divider type are replaced by frequency diplexers or triplexers Dx.

The power which is transmitted in the frequency band ΔF F by coupler C12 to the diplexer Dx passes through this latter with a certain loss and a certain insertion phase shift which are due to the bandpass filter ΔF which forms part of this diplexer. The phase distribution between the different radiating elements for the same beam being prescribed, this insertion phase shift must be compensated for in the elements which are not shared by inserting identical bandpass filters ΔF or, if the frequency band ΔF is very narrow, by inserting transmission line sections which create the same phase shift. This second type of power divider then has the drawback of requiring a large number of filters and multiplexers which must be carefully calibrated in phase; moreover this calibration is only valid for one frequency band so that a fixed frequency band must be attributed to each beam.

FIG. 3 illustrates the principle of a third type of power divider with orthogonal polarization. In this case instead of divider circuits or diplexers, orthogonal polarization couplers CP are used. For example, the feed elements of the first beam E1, E2 and E3 radiate with horizontal linear polarization and those of the adjacent beam E'1, E'2 and E'3 radiate with vertical orthogonal linear polarization.

The disadvantage of this latter type of divider is the limitation of freedom in the relative arrangement of the adjacent beams because only two orthogonal polarizations are available, which excludes in particular continuous two dimensional coverage by the beams; moreover, this power divider uses many polarization couplers; finally, the principle of this divider prevents two orthogonal polarizations from being used in the same beam.

It can be concluded that the power dividing devices known at present require many components which must be calibrated, their losses are high and some do not allow an element to be shared between more than two adjacent beams.

The purpose of the present invention is to provide an antenna in which the "division" of power is provided with a reduced number of components, and with greater efficiency while allowing a secondary radiating element to be shared between several beam feeds.

The invention is characterized by the fact that each secondary radiating element shared between several adjacent beam feeds is fed by the transmission line feeding each main element of said adjacent beams through a single coupler, the shared transmission line of each secondary radiating element comprising at least two couplers in series, each connected to the transmission line of the main element of each primary feed.

With this arrangement, there is no need for divider circuits, diplexers or orthogonal polarization couplers, which appreciably reduces costs both in material and in many hours for calibrations; in addition, with this arrangement power losses may also be reduced substantially.

According to one embodiment of the invention, the couplers feeding the shared secondary radiating elements have a low coupling value, for example of the order of 1/10. In this case, the power loss rate for each shared element is approximately equal to the product of the coupling values of the couplers which feed it.

Other advantages and features of the invention will be clear from the following description made with reference to the accompanying drawings in which.

Figure 4:
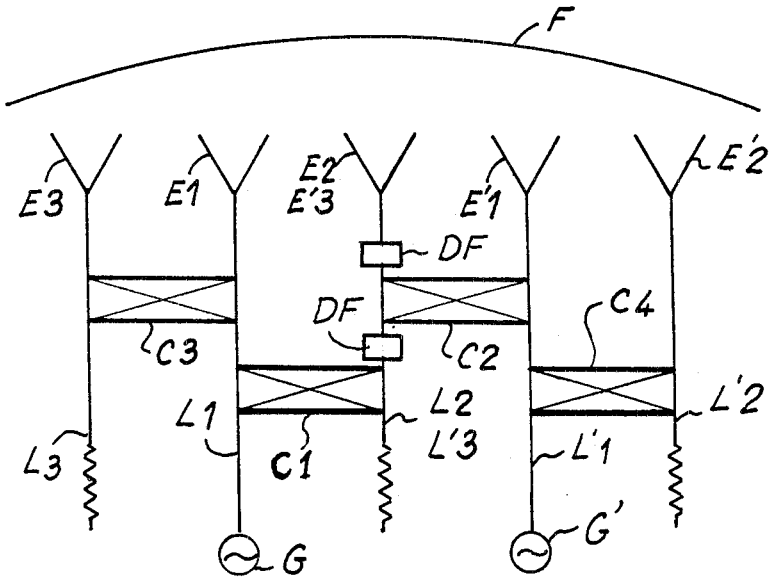
FIG. 4 illustrates the principle of distributing the power in accordance with the present invention.

FIG. 4 illustrates the power distribution principle of the present invention. Shown again are the two adjacent beam feeds each comprising a generator G respectively G' and three radiating elements E1, E2, E3, respectively E'1, E'2, and E'3. According to the invention, the secondary radiating elements shared between the two beam feeds E2 or E'3 is fed directly through a coupler C1, respectively C2, by the transmission line L1 feeding the main element E1 so that the transmission line L2 or L'3 of the shared secondary radiating element E2 or E'3 comprises at least two couplers in series C1 and C2, each of these couplers being connected to the transmission line of the main element of each of the primary feeds sharing the radiating element E2 or E'3.

The power distribution among the unshared secondary elements is provided by means of other couplers C3 respectively C4 coupling line L1 to the transmission line L3 of the secondary element E3, respectively the transmission line L'1 to the transmission line L'2 of the other unshared secondary element E'2. In the example shown, the coupling value of couplers C1 and C4 is 1/10 and the coupling value of couplers C2 and C3 is 1/9; thus, for each primary feed, the power supplied by the generator is distributed for 80% to the main radiating element E1 and for 10% to the secondary elements E2 and E3.

Figure 1:
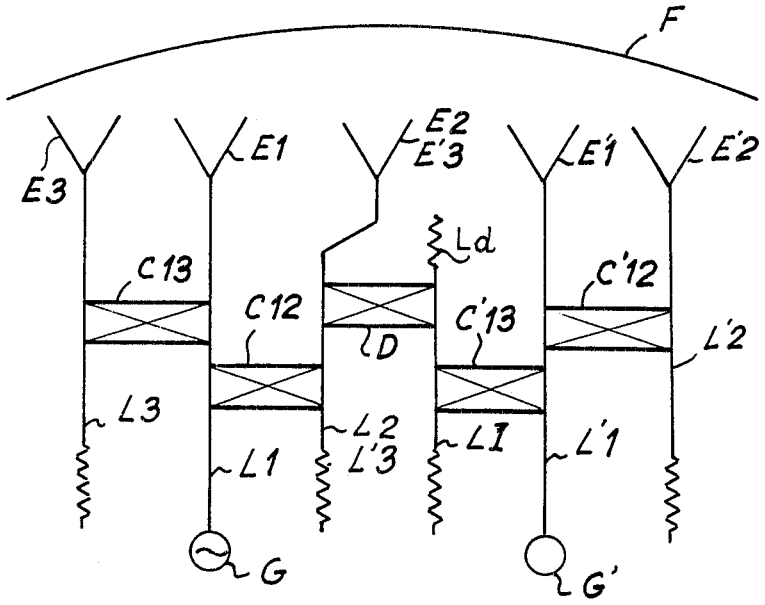
FIG.1 PRIOR ART
FIGS. 1, 2 and 3 illustrate the prior art.
Figure 2:
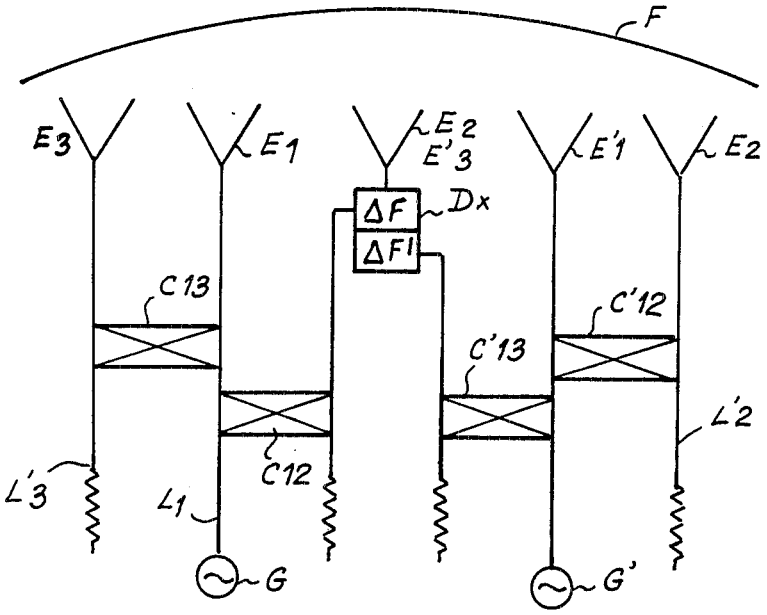
FIG.2 PRIOR ART
Figure 3:
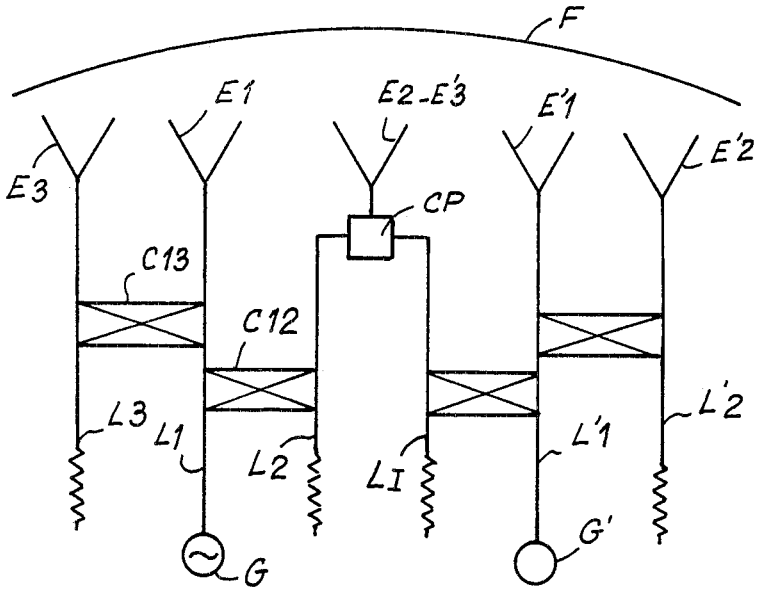
FIG.3 PRIOR ART

It can be seen that the invention allows elimination of the intermediate transmission line L1 of the systems described in FIGS. 1 to 3 and of the component connected to this line, for example the divider circuit D of FIG. 1, the diplexer Dx of the device of FIG. 2 and the orthogonal polarization coupler CP of FIG. 3.

Figure 5:
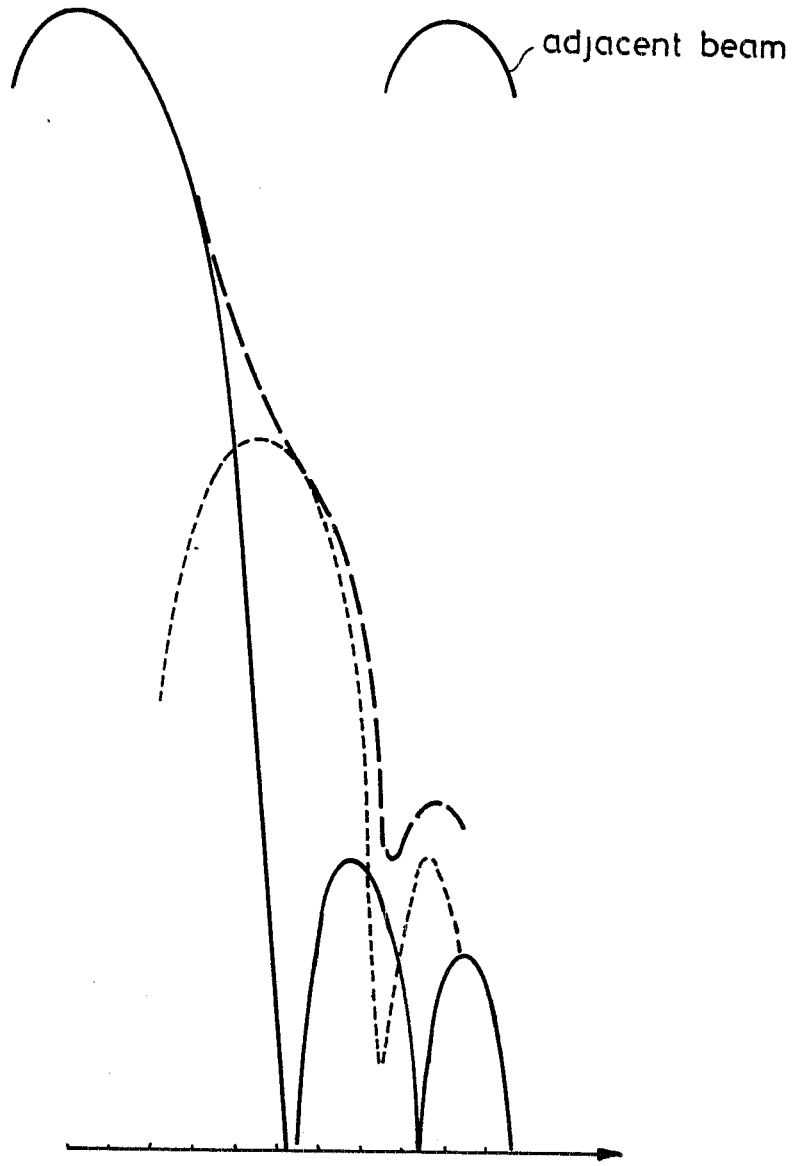
FIG. 5 is a radiation pattern of a beam feed in which the power is divided in accordance with the present invention.

In addition, it can be seen that the power fraction fed by a primary feed into the main radiating element of the adjacent primary feed is close to 1% since the product of the coupling factors of factors C1 and C2 is 1/90; this creates a sidelobe at a relative level of about −20dB in the direction of the adjacent beam, which is not a drawback since two adjacent beams must use different frequencies. The following sidelobes are at a relative level less than −30dB and are negligible. This is illustrated in FIG. 5 where the continuous line is the theoretical shape of the pattern radiated by a primary feed, the dashed line the leakage sidelobes and the broken line the resulting form of the beam radiated by the primary feed with a power divider device in accordance with the invention. It can be seen then that the main advantage of the invention is to provide a power dismain tribution which corresponds to the desired conditions for frequency reuse by closely spaced beams, with a negligible power loss of the order of 1 to 5%, which is an appreciable improvement with respect to existing systems.

The reduced power loss is due to the fact that the coupling factors of the couplers connecting the shared secondary radiating elements to the main transmission line of each of the beams between which they are shared, is of the order of 10%, the loss factor then being 1% for each of the beams sharing a secondary radiating element.

The principle of the invention has been described with a simplified example comprising two beam feeds and five radiating elements, but the invention is applicable to more beam feeds comprising a higher number of secondary radiating elements which may be shared between more than two adjacent beam feeds ; moreover, each beam feed may comprise several shared radiating elements.

Figure 6:
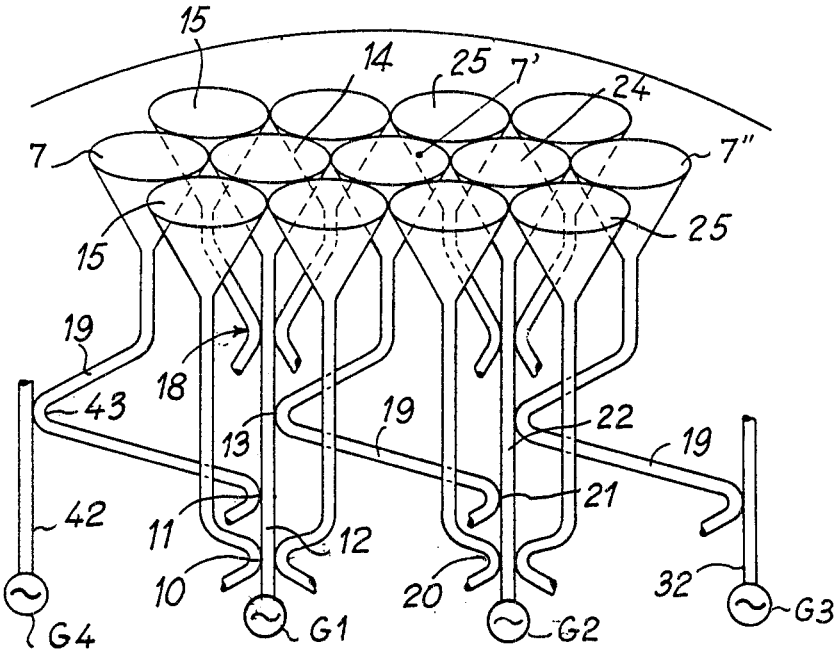
FIG. 6 shows one example of application of the invention to an antenna system comprising seven elements per beam.

FIG. 6 shows the component parts of a conventional antenna system comprising a power divider in accordance with the invention. In this system, each beam feed comprises a central radiating element 14, 24, surrounded by six peripheral secondary elements 15, 25 some of which referenced 7, 7' and 7'' are shared between two adjacent primary feeds. Each generator G1, respectively G2, G3, G4 feeds a transmission line 12 (respectively 22, 32, 42) of the central radiating element 14, respectively 24 (the other two central elements have not been shown for the sake of clarity). Each transmission line 12 of the main element comprises two first couplers 10 distributing the power to two unshared secondary radiating elements, then a second coupler 11 distributing the power to a second secondary radiating element 7' which is shared with the beam fed by generator G2 and finally two fourth couplers 18 which distribute the power to the other two unshared secondary radiating elements.

It can be seen that in this case again each shared radiating element is fed by a transmission line 19 comprising two couplers, such as 11 and 43 so that these two couplers take the desired power from two transmission lines with one main radiating element; when the secondary radiating element is shared by more than two beam feeds, the desired power is then taken from each of these beam feeds.

It is necessary to adjust the length of the transmission lines feeding each shared radiating element between two series couplers and between the last coupler and the secondary radiating element so as to avoid a phase shift. This phase adjustment may be provided by adjusting the length of this line to obtain the appropriate phase shift; this adjustment may also be provided by introducing conventional type phase shifters such as phase shifters DF, shown in FIG. 4, in line L2 or L'3 between couplers C1 and C2 and between coupler C2 and the radiating element E2.

It should be noted that the antenna of the invention may operate either in transmission or reception, mode or both, the end of the transmission line of the main radiating element forming an input, an output or both at the same time.

The transmission lines of the antenna in accordance with the invention may be any type of radioelectric wave transmission lines such as waveguides, coaxial lines or microstrips.

The couplers used for power distribution are so called directive couplers and are compatible with the transmission lines used.

The main and secondary radiating elements are of any type able to be grouped together for feeding a focusing system; they may for example be horns, dipoles or helices. The secondary radiating elements may be of a different type than the main radiating elements. Thus the invention may also be used for shaped beams which emanate from central horns radiating the largest part of the power and surrounded by smaller horns illuminating the frontier zones shared between two beams and only receiving a small part of the power of the beam because of their sma-1 relative size.

It is also possible to dispose a frequency converter and/or amplifier between each radiating element and the last coupler of its energy transmission line.

The focusing system may comprise a lens instead of reflector F or any system formed of reflectors and/or lenses. The invention may be applied for example to a satellite antenna which must be able to radiate signals simultaneously with a gain of 48 dBi to earth stations whose angular distances seen from the satellite are of the order of the half power width of the beams radiated by the antenna. In this case, the same frequencies are used again for communications between the satellite and certain earth based stations and the levels of the lateral lobes of the beams must then be very low so as to limit interference. The problem of radiating closely spaced pencil beams with very low lateral lobes, with a focusing system, is solved by using for each beam a primary feed having seven elements, the peripheral elements being shared between the adjacent beams.

Figure 7:
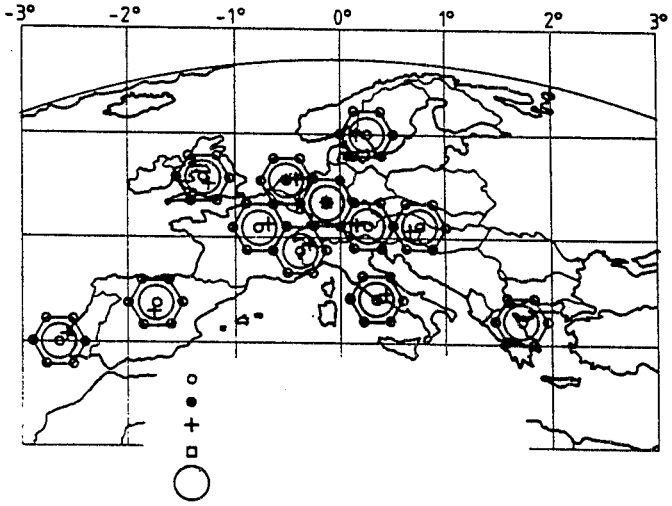
FIG. 7 shows multibeam antenna coverage with some of the feeds comprising shared elements.

FIG. 7 is a chart showing the coverage zones of the primary elements having seven horns, the shared secondary radiating elements being indicated. It can be seen that some beams share a common secondary element and that other beams share other common secondary elements between them.

Figure 8:
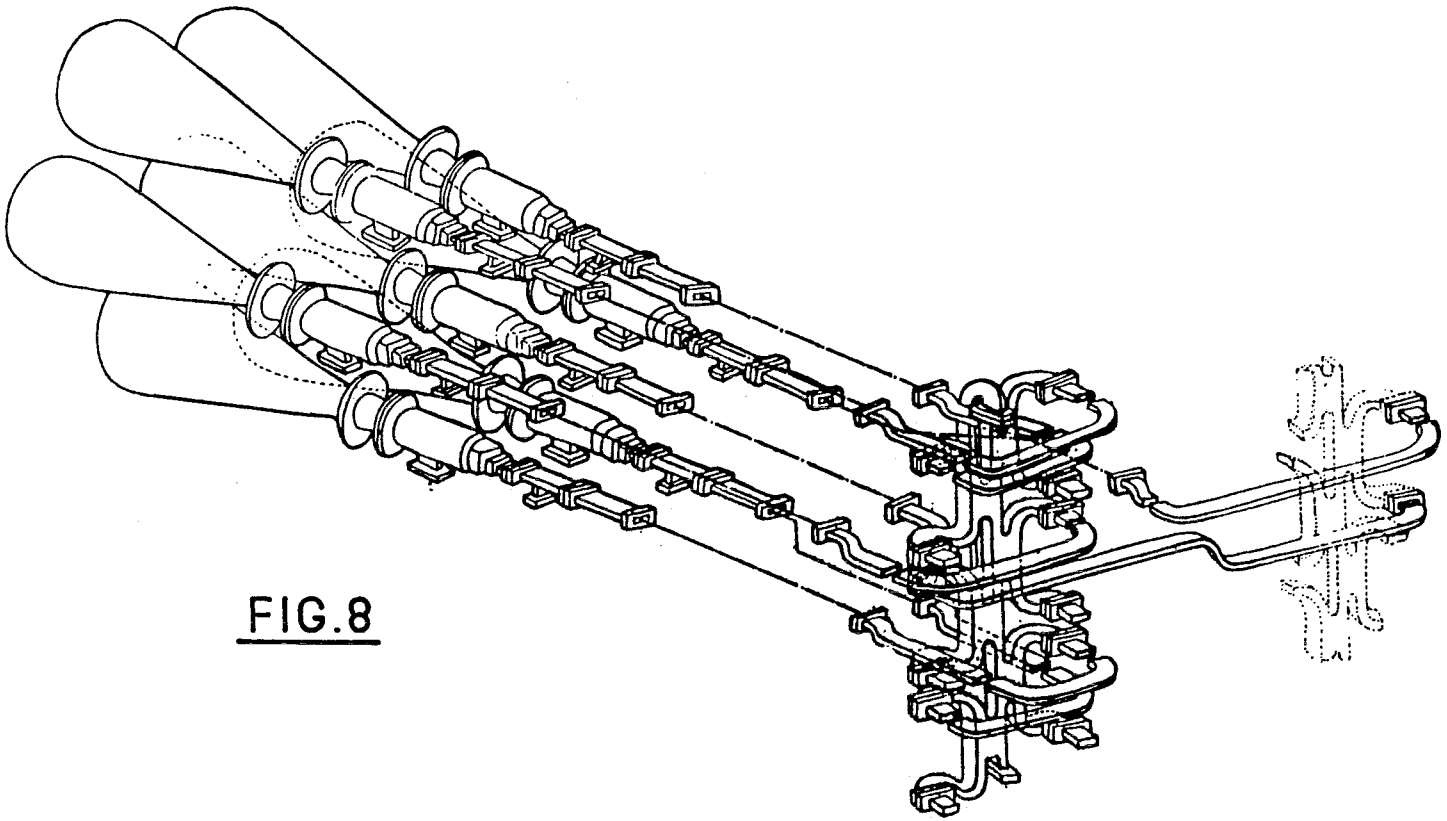
FIG. 8 shows one embodiment of the invention applied to a beam feed comprising seven horn-type radiating elements.

FIG. 8 shows a practical construction of the device of FIG. 6. A seven element divider assembly feeds seven horns by their "horizontal" inputs. The horns have two other inputs not related to the invention. The divider assembly for the adjacent beam is shown by dotted lines. One of the seven horns is shared between the two beam feeds. The power from the first divider (first beam feed) is coupled to a waveguide which is connected to the second divider of the adjacent beam feed which adds, by means of a coupler, the power of the second beam feed which adds, by means of a coupler, the power of the second beam feed intended for the horn. The powers of the first beam feed and of the second beam feed are then guided as far as the horn. A small part ($\approx$ 1%) of the total power of the first beam feed is then coupled during its passage to the central horn of the second beam feed.

The invention is particularly advantageous in the case of antennas onboard satellites since the number of components can be reduced and at the same time the structure of the antennas simplified, which results in a reduction of weight thereof, and the power used can be reduced because of the reduction of losses, which further results in a reduction of weight of the assembly carried by the satellite.

We claim:

1. An antenna for transmitting or receiving closely spaced multiple beams, with very low level sidelobes, of the type comprising, for each beam, a beam feed consisting of a primary source (G; G'1) feeding several radiating elements (E1, E2, E3; E'1, E'2, E'3), through a feed line (L1; L'1), the primary source (G; G') having at least one main element (E1; E'1) surrounded by a plurality of secondary radiating elements (E2, E3; E'2, E'3) some of which (E2; E'3) are shared between several adjacent beam feeds, the power supplied by the primary source (G; G') being distributed to the different elements by means of couplers, characterized in that each secondary radiating element (E2; E'3) shared between at least two adjacent beams feeds is fed from each of the power transmission lines (L1; L'1) feeding the main element (E1; E'1) of said adjacent beams through a respective coupler (C1, C2), each coupler (C1, C2) being mounted is series on the transmission line (L2, L'3) of the secondary radiating element (E2, E'3) shared.

2. An antenna according to claim 1, characterized in that the couplers (C1, C2) feeding the secondary radiating element to be shared (E2, E'3) between said adjacent beams have a low coupling factor with the feed line (L1, L'1) of the main elements (E1, E'1) of said adjacent beams.

3. The antenna according to claim 2, characterized in that the coupling factor is of the order of 1/10.

4. The antenna according to claim 1, characterized in that the feed line (L2, L'3) of each shared secondary radiating element (E2, E'3) comprises two phase shifters (DF) respectively inserted between said couplers (C1, C2) and between the last coupler (C2) and said secondary radiating element (E2, E'3) shared.

5. The antenna according to claim 1, characterized in that the length of the sections of the feed line (L2, L'3; 19) of each shared secondary radiating element (E'2, E'3; 7') delimited between said couplers (C1, C2; 21, 13) or between the last coupler (C2; 13) and the radiating element (E2, E'3; 7'') is adjusted for reestablishing the normal phase shift.

6. The antenna according to claim 1, characterized in that a frequency converter is disposed between each radiating element (14, 7') and the last coupler of its respective energy feed line.

7. The antenna according to claim 1, characterized in that an amplifier is disposed between each radiating element and the last coupler of its respective energy feed line.

8. The antenna according to claim 1, characterized in that each beam feed comprises a main radiating element surrounded by six peripheral secondary radiating elements in the form of horns and in that the power transmission lines are waveguides.

* * * * *